United States Patent [19]

Annen et al.

[11] Patent Number: 4,752,299

[45] Date of Patent: Jun. 21, 1988

[54] DYEING OF MIXED-FIBER SUBSTRATES WITH A DISPERSE DYE AND A METAL-COMPLEX DIRECT OR REACTIVE DYE

[75] Inventors: Oskar Annen, Aesch, Switzerland; John A. Hook, Bradford, Great Britain

[73] Assignee: Sandoz Ltd., Basel, Switzerland

[21] Appl. No.: 922,268

[22] Filed: Oct. 23, 1986

[30] Foreign Application Priority Data

Oct. 28, 1985 [GB] United Kingdom ..... 8526505

[51] Int. Cl.[4] ..... D06P 1/16; D06P 3/87; D06P 5/08

[52] U.S. Cl. ..... 8/531; 8/532; 8/543; 8/584; 8/597; 8/599; 8/602; 8/638; 8/674; 8/680; 8/685; 8/686

[58] Field of Search ..... 8/531, 532, 685, 599

[56] References Cited

U.S. PATENT DOCUMENTS

| | | | |
|---|---|---|---|
| 3,795,481 | 3/1974 | von der Eltz et al. | 8/531 |
| 4,599,087 | 7/1986 | Heller et al. | 8/495 |
| 4,654,046 | 3/1987 | Felle | 8/531 |

FOREIGN PATENT DOCUMENTS

| | | |
|---|---|---|
| 1182445 | 2/1970 | United Kingdom . |
| 1428380 | 3/1976 | United Kingdom . |
| 2099007 | 12/1982 | United Kingdom . |

*Primary Examiner*—A. Lionel Clingman

*Attorney, Agent, or Firm*—Gerald D. Sharkin; Richard E. Vila; Thomas C. Doyle

[57] ABSTRACT

A process for dyeing a mixed fibrous substrate comprising applying to the substrate at least one disperse dye and at least one metal containing direct and/or reactive dye in the presence of a complexing agent having a stability constant K value with the metal of the direct or reactive dye of from 6 to 17 inclusive.

26 Claims, No Drawings

DYEING OF MIXED-FIBER SUBSTRATES WITH A DISPERSE DYE AND A METAL-COMPLEX DIRECT OR REACTIVE DYE

The invention relates to a process for dyeing in a single bath a mixed substrate dyeable with a disperse dye and a direct and/or a reactive dye.

One of the problems that arises from dyeing polyester- or polyamide-cellulosic blends of fibres with a disperse dye and a metal-containing direct or reactive dye is that the free metal ions (not complexed to the dye molecule) naturally accompanying the direct or reactive dye interfere with the disperse dye thereby causing a change in its shade of dyeings produced therewith. This in turn affects the reproducbility of shades produced by the disperse dyes.

It has been found that certain sequestering agents such as ethylene diamine tetraacetic acid (EDTA), used for complexing these metal ions tend to cause breakdown of the direct or reactive dye in such systems and that other sequestering agents for complexing these metal ions, such as polyphosphates, do not act efficiently enough to remove all the free metal present under HT-dyeing conditions.

To avoid these problems there is provided a process for dyeing a mixed fibrous substrate comprising applying to the substrate at least one disperse dye and at least one metal-containing direct and/or reactive dye in the presence of a complexing agent having a stability constant (K-value) with the metal of the direct or reactive dye of from 6 to 17 inclusive.

Preferably the substrate is polyester/cellulosic or polyamide/cellulosic substrate, the cellulosic part of which can be regenerated or natural cellulose (or a mixture thereof), preferably cotton.

Preferably the process is carried out in a single bath.

Description of K-values is given in the Handbook "Stability Constants of Metal Ion Complexes: Section I: Organic Ligands (L. G. Sillen) and Section II: Inorganic Ligands" (A. E. Martell)—published by the Chemical Society (London—1964). The definition of K is given on pages x-xvii of the above Handbook and is incorporated herein by reference.

Preferably where a metal and complexing agent have more than one K value, the K value referred to in this Specification is that for the metal and complexing agent in a medium a pH from 4 to 5.5 (preferably at a temperature of 100° to 140° C.).

Preferably K is from 10 to 17 inclusive.

Where dyeing is carried out in the presence of a reactive dye, preferably the complexing agent is such that it does not contain groups that will react with a reactive dye.

Preferred complexing agents include citric acid, biguanidine, amino trimethylenephosphonic acid, ethylene diamine and glycine and derivatives (such as salts) of each above-mentioned complexing agent.

More preferred complexing agents are citric acid and salts thereof.

Most preferably the complexing agent is sodium citrate.

Preferably if the complexing agent is biguanidine or salts thereof, it is biguanidine hydrochloride.

Dyeing of polyester- or polyamide-/cellulosic fibres is usually carried out from 60° to 135° C. and certain metal-containing direct or reactive dyes tend to dissociate at elevated temperatures e.g. above 100° C. and so liberate metal ions during the dyeing process. However, even where there is no liberation of metal at elevated temperatures, there is metal normally associated with but not complexed into a direct or a reactive dye that can interfere with the disperse dyeing. In this Specification "free metal" therefore refers to any metal ions present that are not complexed to the direct or reactive dye, whether present at the start of the dyeing process or produced by dissociation of the dye during the dyeing process.

The amount of "free metal" (for example copper) associated with a direct or reactive dye is calculated by visually comparing the negative effect (i.e. change in hue) of the direct or reactive dye on a disperse dye dyeing with the negative effect of various concentrations of a copper sulphate solution on a dyeing of the same disperse dye. Where the effect is the same the copper sulphate content is taken to be the "free metal content" for the direct or reactive dye. Analogous methods using other known metal salts can be used to determine the free metal content of a direct or reactive dye. The amount of free metal of a direct or reactive dye can also be determined by Atom Absorption Spectroscopy (for example as described in Flame Emissin and Atomic Spectroscopy—John R. Dean, Vol. 1 Chapter 1, [III]). A Perkin Elmer Spectrometer is preferably used.

Preferably the ratio of the amount of complexing agent to the amount of free metal present in the dyeing process is 20:1 to 1000:1 by weight.

When dyeing according to the invention is carried out at temperatures above 100° C. and the metal-containing direct or reactive dye used in the process is one that liberates metal during the process preferably the ratio of complexing agent to free metal is 500:1 to 1000:1. Where in the dyeing process no metal is liberated during the process the amount of complexing agent to free metal is 20:1 to 100:1.

Preferably the temperature of the dyebath in a single bath process is raised from 60° to 135° C. during the dyeing process. Preferably dyeing with the disperse dye is carried out at 125° to 135° C. for 15 to 45 minutes and preferably dyeing with the direct or reactive dye is carried out at 60° to 80° C. for 15 to 45 minutes.

Preferably the metal of the direct or reactive dye is copper.

Preferably a process according to the invention is carried out using at least one disperse dye and at least one direct dye.

Preferably direct dyes used in the process of the invention are selected from the following:

C.I. Direct Yellow 98
C.I. Direct Yellow 162
C.I. Direct Blue 77
C.I. Direct Blue 251
C.I. Direct Blue 90
C.I. Direct Brown 240
C.I. Direct Black 118
C.I. Direct Yellow 106
C.I. Direct Red 89
C.I. Direct Blue 85 or
a compound of formula

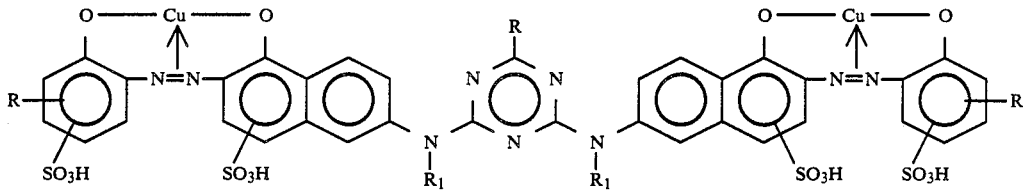

where R is halogen, hydrogen or $C_{1-4}$alkyl and $R_1$ is hydrogen or $C_{1-4}$alkyl. The more preferred direct dyes used in a process according to the invention are those selected from C.I. Direct Brown 240
C.I. Direct Black 118
C.I. Direct Blue 251
C.I. Direct Blue 90
C.I. Direct Blue 77
C.I. Direct Blue 85

The above-mentioned direct dyes are metal-containing and the free metal that is associated with them, in the absence of the complexing agents of the process of the present invention, is such as to cause a noticeable adverse effect on the disperse dye dyeing of polyester or polyamide material. The preferred disperse dyes that are used in a process according to the invention are those that are susceptible to shade change by metals according to modified ISO Test Z02. The modification to ISO Test Z02 is that the polyester dyeing is carried out in the presence of a metal salt at 130° C. instead of 98° C. More preferably the disperse dyes are those having values of less than 4–5 according to the modified ISO Test Z02, most preferably in the range 1–4.

Preferred reactive dyes are those metal-containing reactive dyes that have an appreciable effect on the disperse dye of a disperse dyeing of the polyester or polyamide material.

Preferably a process according to the invention is carried out in a machine for jet dyeing, preferably fully flooded.

Preferably the pH of a process according to the invention is 4–6, more preferably 4–5.5.

In a process according to the invention further standard additives, such as Glauber salt and anionic dispersing agents may be used.

Preferred polyester/cellulosic substrates are polyester/cotton and polyester/viscose.

Preferably in a process according to the invention the polyester- or polyamide-cellulosic substrate is aftertreated with one or more of the following products:

($A_1$) the product of reacting a mono- or polyfunctional primary or secondary amine with cyanamide, dicyandiamide, guanidine or biguanidine whereby up to 50 mole % of the cyanamide, dicyandiamide, guanidine or biguanidine may be replaced with a dicarboxylic acid or mono- or diesters thereof, the product containing reactive hydrogen bound to nitrogen; or ($A_2$) the product of reacting $A_1$ above with an N-methylol derivative of a urea, melamine, guanamine, triazinone, urone, carbamate or acid amide optionally in the presence of a catalyst for cross-linking of N-methylol compounds of the above type; or ($A_3$) the product of reacting $A_1$ above with epichlorohydrin.

Product $A_1$ and $A_2$ are described in British Patent No. 2,070,006B and U.S. Pat. No. 4,410,652 and Products $A_3$ are described in British Published Patent Application No. 2,142,642A and U.S. Pat. No. 4,439,203 and U.S. Ser. No. 652,812 filed 28th June, 1984 the contents of which are all incorporated by reference.

The invention will now be illustrated by the following Examples in which all parts and percentages are by weight and all temperatures are in +C. unless indicated to the contrary. All percentages are based on the amount of substrates used unless indicated to the contrary.

EXAMPLES 1 AND 2

A dyeing bath is made up as given in Table 1 below and the pH is brought to 5 by the addition of formic acid.

5 g of a cellulose/polyester (50:50) substrate is entered into 75 $cm^3$ dyeing bath at a goods to liquor ration of 1:15 and 60° and the temperature is raised from 60° to 130° over 20 minutes. The dyeing is cooled to 60° over 20 minutes and the bath drained off from the dyeing. The dyeing is washed.

The dyeing is aftertreated with the product of reacting the condensation product of dicyandiamide and diethylene triamine with epichlorohydrin.

TABLE 1

| Example 1 | Example 2 |
|---|---|
| 0,5% C.I. Direct Blue 251 | 1% C.I. Direct Brown 240 |
| 0,6% C.I. Disperse Blue 79 | 1% of a dyestuff mixture comprising |
| 10 g/l Glauber salt | 20 parts of C.I. Disperse Blue 79 |
| 1 g/l dinaphthylmethane sodium disulphonate | 12 parts of C.I. Disperse Orange 30 |
| 2 g/l Ammonium sulphate | 6 parts of C.I. Disperse Red 54 |
| 2 g/l sodium citrate | 10 g/l Glauber salt |
| | 1 g/l dinaphthylmethane sodium disulphonate |
| | 2 g/l Ammonium sulphate |
| | 2 g/l sodium citrate |

The resulting dyeings show excellent fastness of the disperse and the direct dye.

Similar results can be obtained by using an equivalent amount of aminotrimethylene phosphonic acid, ethylene diamine or glycine instead of sodium citrate.

EXAMPLES 3 TO 9

200 kg of a polyester/viscose (50:50) piece is placed in a Ventura jet dyeing machine at 60° in a bath of 1800 liters containing 2 g/l of a commercially available pH buffer, 2 g/l of citric acid and 2 g/l of dinaphthylmethane sodium disulphonate and the pH is adjusted to 5 with formic acid.

The direct dyes (predissolved in boiling water) in the amounts given in Table 2 below, are added to the dyebath and allowed to stand for 10 minutes. Then the disperse dyes (predispersed in water at 50°) are added. The temperature is raised to 130° over 40 minutes and dyeing at 130° is carried out for the time periods as given in Table 2 below.

After dyeing at 130° the temperature is reduced to 70° at 2° per minute and the piece is then washed and dried.

The pieces can then be aftertreated as described in Examples 1 and 2.

The resulting dyeings of Examples 10 to 12 show good fastness of both the disperse and reactive dyes on their substrate.

TABLE 2

| Example No. | Colour of dyeing | Direct Dyes | Disperse Dyes | Dyeing time at 130° C. |
|---|---|---|---|---|
| 3 | Navy | 0.64% C.I. Direct Blue 251<br>0.07% C.I. Direct Yellow 16<br>0.064% C.I. Direct Red 89 | 0.96% of Disperse Dye Mix 1<br>0.10% of C.I. Disperse Yellow 235<br>0.09% of Disperse Dye Mix 2 | 15 minutes |
| 4 | Grey | 0.43% C.I. Direct Red 89<br>0.044% C.I. Direct Yellow 162<br>0.06% C.I. Direct Blue 85 | 0.072% of Disperse Dye Mix 3<br>0.043% of Disperse Dye Mix 2<br>0.022% of C.I. Disperse Yellow 235 | 5 minutes |
| 5 | Grey | 0.0085% C.I. Direct Black 118<br>0.009% C.I. Direct Brown 240<br>0.0008% C.I. Direct Yellow 162 | 0.021% of Disperse Dye Mix 3<br>0.011% of Disperse Dye Mix 2<br>0.008% of C.I. Disperse Yellow 235 | 5 minutes |
| 6 | Blue | 0.11% of C.I. Direct Blue 77 | 0.005% of C.I. Disperse Yellow 235<br>0.14% Disperse Dye Mix 3 | 5 minutes |
| 7 | Navy | 0.19% of C.I. Direct Red 89<br>0.20% of C.I. Direct Yellow 162<br>0.47% of C.I. Direct Blue 251 | 0.19% of C.I. Disperse Orange 30<br>0.06% of C.I. Disperse Red 167:1<br>0.35% of C.I. Disperse Blue 79 | 45 minutes |
| 8 | Black | 1.2% of C.I. Direct Blue 251<br>1.15% of C.I. Direct Brown 240<br>0.33% of C.I. Direct Yellow 162 | 0.37% of Disperse Dye Mix 4<br>0.045% of Disperse Yellow 235<br>0.06% of Disperse Dye Mix 1 | 15 minutes |
| 9 | Green | 0.9% of C.I. Direct Blue 77<br>1.05% of C.I. Direct Yellow 98<br>0.1% of C.I. Direct Yellow 162 | 0.46% of C.I. Disperse Yellow 235<br>0.77% of Disperse Dye Mix 3 | 15 minutes |

| Disperse Dye Mix 1 is a mixture of: | Disperse Dye Mix 3 is a mixture of: |
|---|---|
| C.I. Disperse Blue 183 | C.I. Disperse Blue 183 |
| C.I. Disperse Blue 81 | C.I. Disperse Blue 165:1 |
| C.I. Disperse Blue 180 | C.I. Disperse Blue 291 |
| C.I. Disperse Blue 79 | C.I. Disperse Blue 79 |
| C.I. Disperse Violet 63 | C.I. Disperse Violet 93:1 |
| **Disperse Dye Mix 2 is a mixture of:** | **Disperse Dye Mix 4 is a mixture of:** |
| C.I. Disperse Red 50 | C.I. Disperse Blue 183 |
| C.I. Disperse Red 56 | C.I. Disperse Blue 81 |
| C.I. Disperse Red 312 | C.I. Disperse Blue 180 |
| C.I. Disperse Red 73 | C.I. Disperse Blue 79 |
| C.I. Disperse Red 167:1 | C.I. Disperse Violet 63 |
| | C.I. Disperse Orange 25 |
| | C.I. Disperse Orange 96 |

In Examples 4, 5 and 8, the substrate used was polyester/cotton instead of polyester/viscose.

EXAMPLE 10

A two step one bath dyeing procedure is carried out as follows:

A dyebath containing 0.4% Foron Black RD-2 GL 200%; 1.0% C.I. Reactive Blue 209; 1 g/l of a dispersing agent based on the condensation product of formaldehyde and naphthalene sulphonic acid; 40 g/l Glauber salt (calcine); 2 g/l soda (calcine) and 2 g/l sodium citrate is made up.

5 g of a polyester/cellulose substrate is added at 40° at a goods to liquor ratio of 1:10 and the temperature is raised over 45 minutes to 70°. The bath is held at this temperature for 45 minutes, after which the bath is brought to a pH of 5 by the addition of formic acid.

The temperature is then brought to 130° over 45 minutes and held at this temperature for 20 minutes after which the temperature is reduced to 70° and the bath is dried off and the dyeing is washed.

The product is then aftertreated in a bath of 2 g/l of the dispersing agent defined above in water for 20 minutes at 80° C.

EXAMPLES 11 AND 12

Further dyeings are carried out using the method of Example 10 except that instead of 1% C.I. Reactive Blue 209, 1% of C.I. Reative Violet 33 (Example 11), and 1% of Remasol Blue 3R (Example 12) is used.

EXAMPLES 13 AND 14

Furthr dyeings may be made using the method of Example 10, except that instead of 1% Reactive Blue 209, 1% of C.I. Reactive Blue 52 (Example 13) and 1% C.I. Reactive Violet 6 (Example 14) is used and instead of aftertreating with the dispersing agent of Example 10, aftertreatment occurs in a bath of 1 mg/l of a $C_{15}$ alcohol ethoxylated and propoxylated and 1 g/l of sodium tripolyphosphate in water at 90° for 20 minutes.

The resulting dyeings show excellent exhaust properties of the reactive and disperse dyes and fastness properties of the resultant dyeing are good.

What is claimed is:

1. A process for dyeing a polyester/cellulose or polyamide/cellulose substrate comprising exhaust dyeing the substrate with at least one disperse dye and at least one metal complex direct and/or reactive dye in the presence of a complexing agent having a stability constant K value with the metal of the direct or reactive dye of from 6 to 17 inclusive.

2. A process according to claim 1 in which the complexing agent has a K value of 10 to 17 inclusive.

3. A process according to claim 1, in which the complexing agent is selected from citric acid, biguanidine, amino trimethylene phosphonic acid, ethylene diamine and glycine and derivatives of each of the above-mentioned complexing agents.

4. A process according to claim 1, in which the complexing agent is sodium citrate.

5. A process according to claim 1, in which the dyeing is carried out in a range from 60° to 135° C.

6. A process according to clam 1, which is carried out using at least one disperse dye and at least one metal complex direct dye.

7. A process according to claim 1, in which the ratio of complexing agent to free metal associated with the metal-complex direct or reactive dye is 20:1 to 1000:1 by weight.

8. A process according to claim 1, in which the pH is from 4 to 6 inclusive.

9. A process according to claim 1, in which the substrate is aftertreated with one or more of the following products:

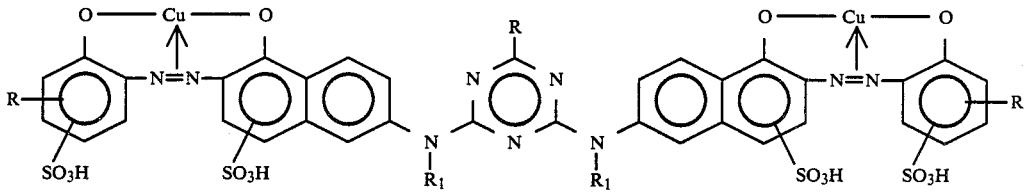

($A_1$) the product of reacting a mono- or polyfunctional primary or secondary amine with cyanamide, dicyandiamide, guanidine or biguanidine whereby up to 50 mole % of the cyanamide, dicyandiamide, guanidine or biguanidine may be replaced with a dicarboxylic acid or mono- or diesters thereof, the product containing reactive hydrogen bound to nitrogen; or ($A_2$) the product of reacting $A_1$ above with an N-methylol derivative of a urea, melamine, guanamine, triazinone, urone, carbamate or acid amide optionally in the presence of a catalyst for cross-linking of N-methylol compounds of the above type; or ($A_3$) the product of reacting $A_1$ above with epichlorohydrin.

10. A polyester/cellulose or polyamide/cellulose substrate which has been exhaust dyed with at least one disperse dye and at least one metal-complex direct and/or reactive dye in the presence of a complexing agent having a K value with the metal of the direct or reactive dye of from 6 to 17 inclusive.

11. A process according to claim 1 wherein the metal of the direct or reactive dye is copper.

12. A process according the claim 1 wherein the metal-complex dye is a direct or a reactive dye having associated with it free metal such as would cause a noticeable adverse effect on the disperse dye dyeing of polyester or polyamide material in the absence of the complexing agent and the disperse dye 13 in one that is susceptible to shade change by metals according to ISO test Z02 modified by carring out the polyester dyeing in the presence of a metal salt at 130° C.

13. A process according to claim 3 wherein the dyeing is effected with a disperse dye and a copper-complex direct dye.

14. A process according to claim 3 wherein the dyeing is effected with a disperse dye and a direct dye selected from the group consisting of C.I. Direct Yellow 98
C.I. Direct Yellow 162
C.I. Direct Blue 77
C.I. Direct Blue 251
C.I. Direct Blue 90
C.I. Direct Brown 240
C.I. Direct Brown 240
C.I. Direct Black 118
C.I. Direct Yellow 106
C.I. Direct Red 89
C.I. Direct Blue 85 and compounds of the formula:

wherein

R is halogen, hydrogen or $C_{1-4}$alkyl, and $R_1$ is hydrogen or $C_{1-4}$-alkyl.

15. A process according to claim 7 wherein the ratio of complexing agent to free metal is 500:1 to 1000:1 when the dyeing is carried out at a temperature above 100° C. and the metal-complex direct or reactive dye is one which liberates metal during the dyeing and the ratio of complexing agent to free metal is 20:1 to 100:1 when no metal is liberated during the dyeing.

16. A process according to claim 12 wherein the complexing agent is selected from citric acid, biguanidine, amino trimethylene phosphonic acid, ethylene diamine and glycine and derivatives of each of the above-mentioned complexing agents and the ratio of complexing agent to free metal associated with the metal-complex dye is 20:1 to 1000:1 by weight and the dyeing is carried out at a temperature in the range 60° to 135° C.

17. A process according to claim 14 wherein the complexing agent is sodium citrate.

18. A process according to claim 16 wherein the complexing agent is sodium citrate.

19. A process according to claim 16 wherein the pH is from 4 to 6, inclusive.

20. A process according to claim 17 wherein the pH is from 4 to 6, inclusive.

21. A process according to claim 18 wherein the pH is from 4 to 6, inclusive.

22. A process according to claim 1 which is carried out in a single bath.

23. A process according to claim 12 which is carried out in a single bath.

24. A process according to claim 17 which is carried out in a single bath.

25. A process according to claim 20 which is carried out in a single bath.

26. A process according to claim 16 wherein the dyeing is carried out in a single bath containing a disperse dye and a metal-complex direct dye.

* * * * *